United States Patent [19]

Nagano et al.

[11] Patent Number: 4,550,705

[45] Date of Patent: Nov. 5, 1985

[54] ELECTRICAL FUEL INJECTOR

[75] Inventors: Masami Nagano; Takeshi Atago; Tatsuya Yoshida, all of Katsuta, Japan

[73] Assignee: Hitachi, Ltd., Tokyo, Japan

[21] Appl. No.: 471,432

[22] Filed: Mar. 2, 1983

[30] Foreign Application Priority Data

Mar. 3, 1982 [JP] Japan ..... 57-32362

[51] Int. Cl.[4] ..... F02D 5/00

[52] U.S. Cl. ..... 123/488; 123/480

[58] Field of Search ..... 123/488, 494, 478, 480

[56] References Cited

U.S. PATENT DOCUMENTS

| | | | |
|---|---|---|---|
| 4,051,818 | 10/1977 | Völckers | 123/494 |
| 4,214,306 | 7/1980 | Kobayashi | 123/480 |
| 4,311,042 | 1/1982 | Hosoya et al. | 123/478 |
| 4,355,614 | 10/1982 | Hayashi et al. | 123/488 |
| 4,425,890 | 1/1984 | Yamaguchi | 123/480 |

FOREIGN PATENT DOCUMENTS 56-24522 3/1981 Japan .

*Primary Examiner*—Andrew M. Dolinar

*Attorney, Agent, or Firm*—Antonelli, Terry & Wands

[57] ABSTRACT

In an electrical fuel injector which comprises an air flow meter for detecting an amount of air intake to an internal combustion engine, a revolution counter for measuring the rate of rotations of the internal combustion engine, and an electronic circuit adapted to arithmetically control an opening time of an injection valve for injecting fuel into the internal combustion engine based on output signals from both air flow meter and revolution counter, a digital filter is provided which has a coefficient variable in accordance with drive conditions of the internal combustion engine, so that the output signal from the air flow meter is applied to the electronic circuit through the digital filter.

7 Claims, 8 Drawing Figures

ELECTRICAL FUEL INJECTOR

FIELD OF THE INVENTION

This invention relates to an electrical fuel injector, and more specifically to an electrical fuel injector which includes an electronic circuit adapted to compute an opening time of an injection valve for injecting fuel into an internal combustion engine, based on output signals from an air flow meter for detecting an amount of air intake to the internal combustion engine and a revolution counter for measuring the rate of rotations of the internal combustion engine.

BACKGROUND OF THE INVENTION

The electrical fuel injector of this type is disclosed, for example, in Japanese Patent Laid Open No. 56-24522 "Basic Pulse Computing Method and Apparatus for Hot-Wire Type Flow Meter" distributed on Mar. 9, 1981.

In this known fuel injector, in order to control an opening time of an injection valve without suffering any influence from an amount of air intake to an internal combustion engine, an air-intake amount detection signal is input to an electronic circuit through a digital filter having a constant coefficient and then an opening time of the injection valve is computed. According to this known fuel injector, however, since the detection signal for the amount of air intake to the internal combustion engine is input to the electronic circuit for computing the opening time of the injection valve through the digital filter having a constant coefficient at all times regardless of the revolution count and load of the internal combustion engine, there arises such a drawback that a rising characteristic of the revolution count is impaired.

SUMMARY OF THE INVENTION

It is an object of this invention to provide an electrical fuel injector which can make revolution count of an internal combustion engine steady while idling without imparing acceleration performance.

In the fuel injector of this invention, there is provided a digital filter which has a coefficient variable in accordance with drive conditions of the internal combustion engine, and an output signal from an air flow meter is applied through the digital filter to an electronic circuit for controlling an opening time of an injection valve.

According to this invention, the coefficient of the digital filter is selected to reduce fluctuations in revolution count of the internal combustion engine while idling, thereby to raise the revolution count of the internal combustion engine while idling in its stability, and the coefficient of the digital filter is changed over during normal drive other than idling, thereby to improve a rising characteristic of the revolution count. Thus, acceleration performance will never be impaired.

DETAILED DESCRIPTION OF THE PREFERRED EMBODIMENT

Figure 1:
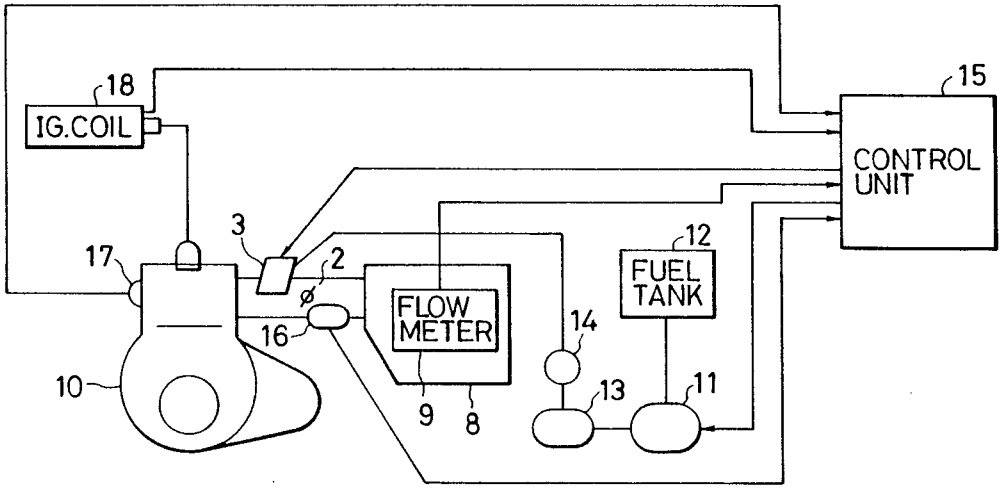
FIG. 1 is a block diagram of an internal combustion engine system in case an electrical fuel injector according to this invention is applied to a multi-cylindered, 4-cycle internal combustion engine system.

Referring to FIG. 1, air passes through a hot-wire type air flow meter 9 installed in an air cleaner 8 and then is fed to an internal combustion engine 10 by an amount in accordance with an opening degree of a throttle valve 2. The air having passed through the air flow meter 9 flows into a surge tank to be distributed to respective cylinders.

On the other hand, fuel is suctioned and pressurized by a fuel pump 11 from a fuel tank 12 and then injected into the internal combustion engine through a fuel filter 13, a regulator 14 and an injection valve 3.

Figure 2:
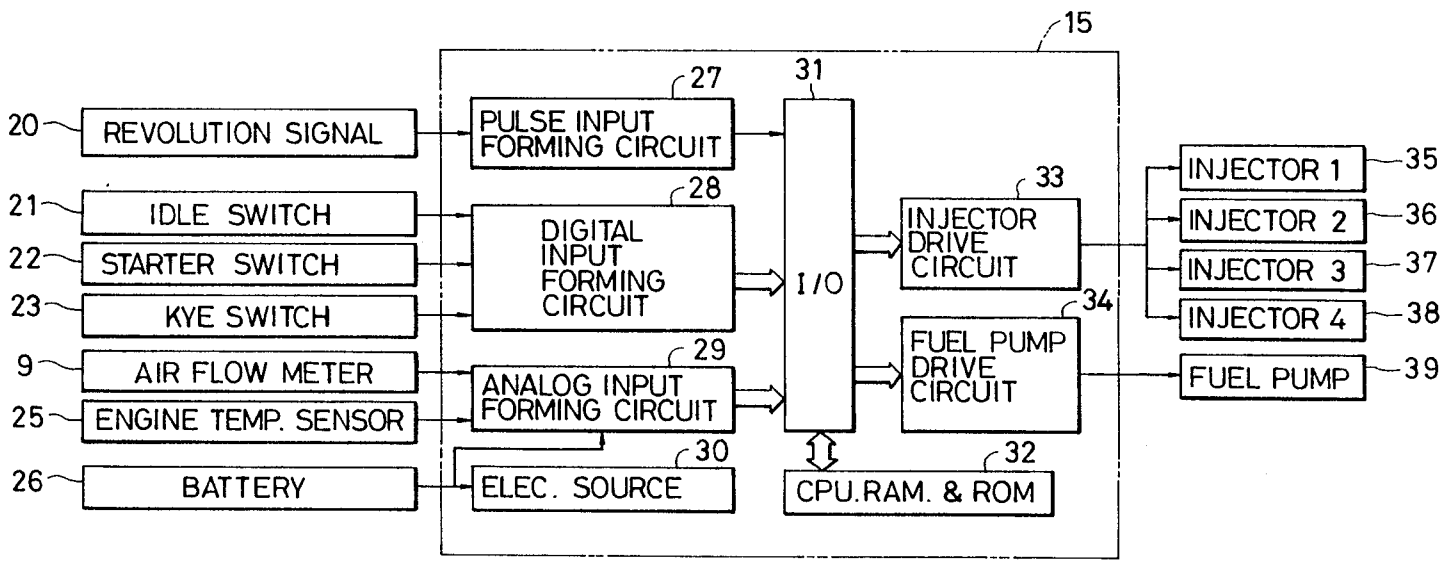
FIG. 2 is a block diagram for control of the electrical fuel injector according to this invention.

The hot-wire type air flow meter 9 outputs a detection signal for amount of air intake and this output signal is applied to a control unit 15. A throttle valve opening degree switch 16 is attached to the throttle valve 2. The switch 16 outputs a detection signal for opening degree of the throttle valve 2 and this output signal is applied to the control unit 15. A head temperature sensor 17 is attached to the internal combustion engine 10. The sensor 17 outputs a detection signal for temperature of the internal combustion engine 10 and this output signal is applied to the control unit 15. Further, an ignition coil 18 outputs a detection signal for revolution count of the internal combustion engine 10 and this output signal is also applied to the control unit. As shown in FIG. 2, the control unit 15 comprises a pulse input forming circuit 27, digital input forming circuit 28, analog input forming circuit 29, CPU, RAM and ROM 32, injector drive circuit 33, fuel pump drive circuit 34. constant voltage electric source 30, and an I/O circuit 31. The pulse input forming circuit 27 is driven by a revolution signal 20 from the ignition coil 18. The digital input forming circuit 28 is driven based on inputs from a key switch 23 for starting the internal combustion engine, a starter switch 22 adapted to issue an instruction used for computing a basic pulse width Tp of fuel injection pulses at the time of starting the internal combustion engine, and an idle switch 21 for detecting an opening degree of the throttle valve 2. The analog input forming circuit 29 is driven based on inputs from the air flow meter 9 and an engine temperature sensor 25. The control unit 15 is supplied with electric power also from an external battery 26 in addition to the electric source 30. The I/O circuit 31 allows inputs from the pulse input forming circuit 27, the digital input forming circuit 28 and the analog input forming circuit 29 to be subject to the later-described calculation in the circuit 32 comprising CPU, RAM as well as ROM, and then it sends out control signals to the injector drive circuit 33 and the fuel pump drive circuit 34. The injector drive circuit 33 receives the computed valve from the CPU throught the I/O circuit and outputs drive pulses to injectors 35 to 38 for driving them, as described later. The fuel pump drive circuit 34 outputs a drive pulse to the fuel pump 39.

The CPU, RAM and ROM circuit 32 incorporates therein a digital filter which is able to multiply an output signal from the air flow meter 9 and, as required, an output signal from the revolution counter 18 by a predetermined coefficient, thereby to carry out the arithmetic processing as mentioned below. Based on thus computed result, the injection valve 3 is opened to the desired opening degree, so that the required amount of fuel is injected into the respective cylinders 35 to 38. At this time, the basic pulse width Tp of fuel injection pulses is proportional to an air-intake amount Q to the internal combustion engine and is inversely proportional to revolution count N thereof;

$$Tp \propto Q/N \quad (1)$$

Also, a relationship between the coefficient of the digital filter and input data (DATA) to the CPU, RAM and ROM circuit 32 is expressed as follows;

$$DATA = COEFFICIENT(DATA_{new} - DATA_{old}) + DATA_{old} \quad (2)$$

On this occasion, the coefficient X of the digital filter to be multiplied by the output signals from the air flow meter 9 and the revolution counter 18 can be varied in its value in accordance with the state of the internal combustion engine. As illustrated in the following table, for example, the coefficient X is set to assume $X_1$ in case the idle switch is turned ON, the revolution count is less than N, the valve opening pulse width is less than Tp and the air-intake amount is less than Qa while idling, whereas it assumes $X_2$ in case the idle switch is turned OFF, the revolution count is more than N, the valve opening pulse width is more than Tp and the air-intake amount is more than Qa while idling. Such decision conditions are not necessarily required to include all of those parameters and may consist of one or two among them. For example, only the ON/OFF condition of the idle switch may be selected for decision. As an alternative, decision can be made based on AND or OR condition of two or more parameters.

| | | | |
|---|---|---|---|
| Decision conditions | 1 | Idle switch ON | Idle switch OFF |
| | 2 | below N (rpm) | above N (rpm) |
| | 3 | below Tp (msec) | above Tp (msec) |
| | 4 | below Qa (g/min) | above Qa (g/min) |
| Coefficient of digital filter | | $X_1$ | $X_2$ |

In the above table, the item of idle switch ON or OFF designates that the opening degree of the throttle valve is below or above 1 degree, for example, respectively. The item of revolution count below or above N designates that the revolution count is less than or more than 1500 rpm, for example, respectively. The item of valve opening pulse width below or above Tp designates that it is shorter than or longer than 1.7 msec, for example, respectively. Further, the item of air-intake amount below or above Qa designates that the amount is less than or more than 125 g/min, for example, respectively. In addition, by way of example, the coefficient $X_1$ means a value of 0.5, whereas the coefficient $X_2$ means a value of 1.0

Figure 3:
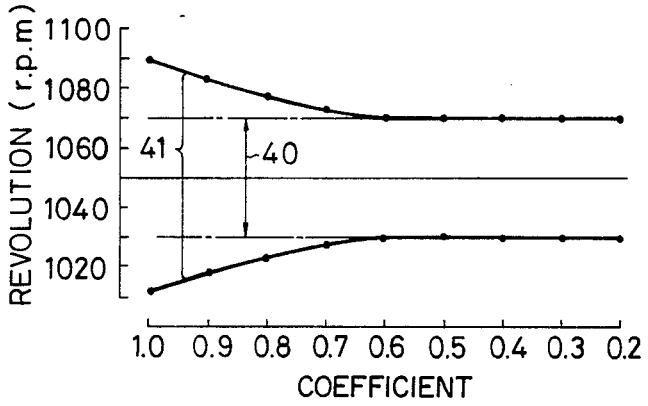
FIG. 3 is a graph showing the measured result of a relationship between coefficients of a digital filter and a fluctuation range in revolution count of the internal combustion engine while idling.

FIG. 3 shows a method for determining a value of the coefficient of the digital filter which is used in the electrical fuel injector according to this invention. Stated differently, FIG. 3 shows the measured result of a relationship between the coefficient of the digital filter and a fluctuation range of revolution count (rpm) while idling, in which the reference numeral 40 denotes an objective range and 41 denotes the measured range. As will be apparent from FIG. 3, in case the idling switch is turned ON, an allowable revolution fluctuation range of the internal combustion engine can be held within the objective range, by selecting the coefficient of the digital filter at 0.5.

Figure 4A:
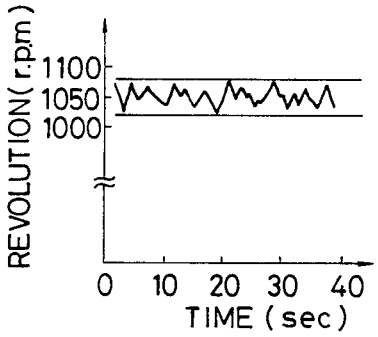
FIGS. 4A and 4B are graphs showing the measured results of fluctuation ranges of revolution count of the internal combustion engine with respect to the lapse of time while idling in the prior art and in this invention, respectively.
Figure 4B:
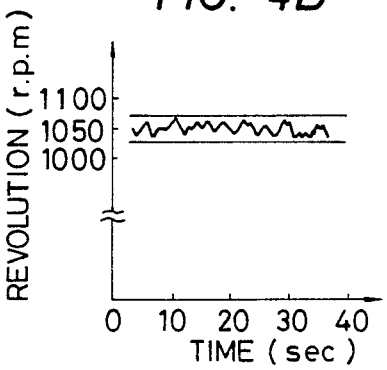

FIG. 4A is a graph showing a revolution fluctuation range (rpm) of the internal combustion engine in case of using no digital filter, which range changes along with the lapse of time. FIG. 4B is a graph showing a revolution fluctuation range (rpm) of the internal combustion engine which changes along with the lapse of time, in case that both air flow signal and revolution signal are fed to the digital filter thereby to control an opening time of the injection valve. As will be apparent from FIG. 4A, in case of using no digital filter the internal combustion engine assumes a revolution fluctuation range of 100 to 60 rpm. According to the experiment carried out by the inventors, in case only the air flow signal is fed to the digital filter as previously noted referring to the known injector in the prior art, the internal combustion engine assumes a revolution fluctuation range of about 60 rpm. On the other hand, as will be apparent from FIG. 4B, in case that both air flow signal and revolution signal are fed to the digital filter, a revolution fluctuation range of the internal combustion range can be restrained within 40 to 10 rpm. In cases of FIG. 4A and the above-mentioned known injector wherein a revolution fluctuation range of the internal combustion engine is varied in values from 100 to 60 rpm, there occurs a noise such that the engine is likely to stop, whereas in case that the internal combustion engine assumes a revolution fluctuation range of 40 to 10 rpm, there will never occur a noncomfortable feeling.

Figure 5:
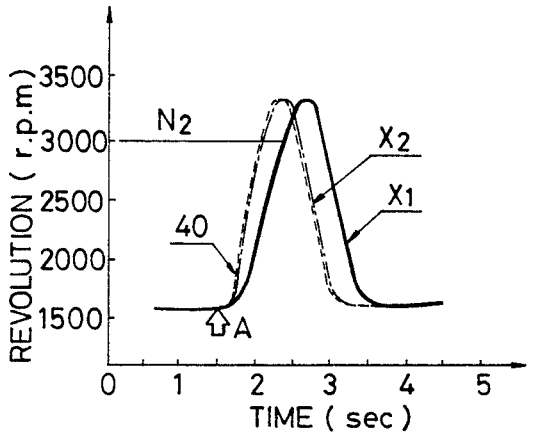
FIG. 5 is a graph showing the measured results of rising characteristics of revolution count of the international combustion engine with respect to the lapse of time when rapidly opening a throttle valve to its full-open state in the prior art and in this invention.

FIG. 5 shows the result of measuring a rising time up to a predetermined revolution count $N_2$ (3000 rpm), when opening the throttle valve 2 to its fullopen state in the actual motor vehicle with the coefficient of the digital filter being selected at $X_1$ and $X_2$. In FIG. 5, the reference numeral 40 denotes a rising characteristic in case of using no digital filter. It will be apparent from FIG. 5 that a rising characteristic with the digital filter assuming the coefficient $X_2$ during normal drive other than idling becomes the same as that in case of using no digital filter.

Accordingly, it is possible to attain good acceleration performance comparable to the conventional injector using no digital filter, while improving stability of revolution count during idling drive, by detecting the state of the internal combustion engine and then changing a coefficient of the digital filter in accordance with the detected result.

Hereinafter, flowcharts for the electronic fuel injector of this invention will be described by referring to FIGS. 6 and 7.

Figure 6:
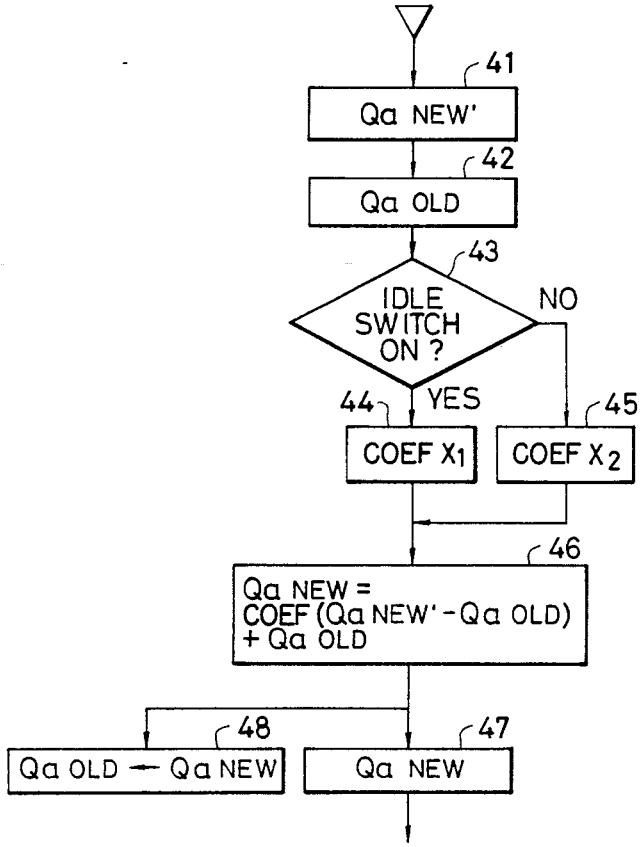
FIG. 6 is a flowchart used for changing a coefficient of the digital filter with an idle switch signal, when applying an air flow signal to an electronic circuit through the digital filter so as to control an opening time of an injection valve.
Figure 7:
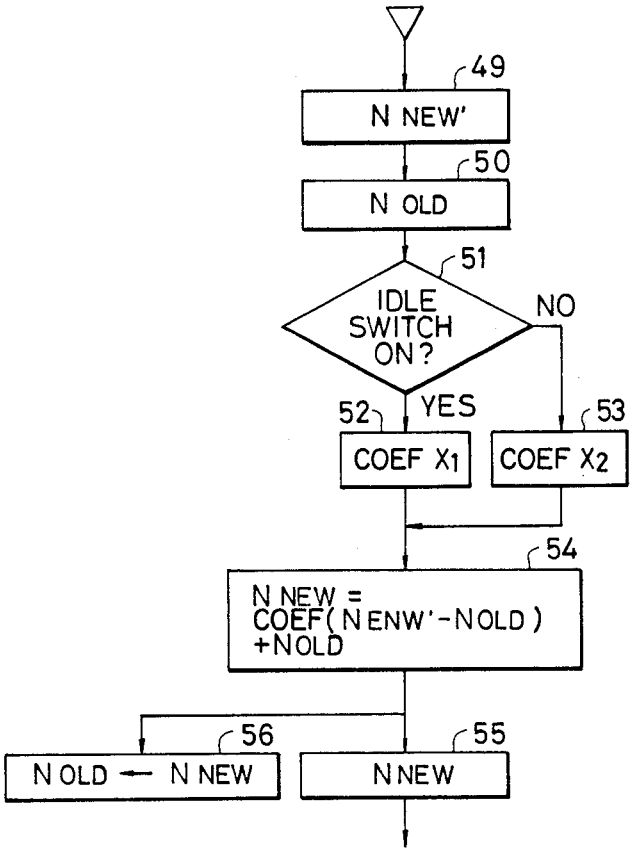
FIG. 7 is a flowchart used for changing a coefficients of the digital filter with the idle switch signal, when applying a revolution count detection signal to the electronic circuit through the digital filter so as to control the opening time of the injection valve.

As shown in FIG. 6, updated new air flow signals $Q_{aNEW}$, are input to the analog input forming circuit 29 from the air flow meter 9 one after another in a step 41. These signals $Q_{aNEW}$, are stored in the RAM of the circuit 32 as signals $Q_{aold}$ as shown in a step 42. In a next step 43, it is judged whether the idle switch is turned ON or OFF. When the idle switch is turned ON, the coefficient $X_1$ is read out from the ROM in the circuit 32 in a step 44 in response to an instruction from the CPU. When the idle switch is turned OFF, the coefficient $X_2$ is read out from the ROM in a step 45 in response to an instruction from the CPU. In a next step 46, the above-mentioned calculation as shown in the Equation (2) is carried out in the CPU of the circuit 32 based on the coefficient $X_1$ or $X_2$ read out in the step 44 or 45. This computed value is used as a signal of Q shown in the aforesaid Equation (1) in a step 47. At the same time, the value $Q_{aNEW}$ computed in the step 46 is stored in the RAM of the circuit 32 as $Q_{aold}$, which is used for next calculation in the step 46 as the than signal of $Q_{aold}$.

On the other hand, updated new revolution signal $N_{NEW}$, is input to the pulse input forming circuit 27 in a step 49. This signal $N_{NEW}$, is stored in the RAM of the circuit 32 as a signal $N_{old}$ as shown in a step 50. In a next step 51, it is judged whether the idle switch is turned ON or OFF. When the idle switch is turned ON, the coefficient $X_1$ is read out from the ROM in the circuit 32 in a step 52 in response to an instruction from the CPU. When the idle switch is turned OFF, the coefficient $X_2$ is read out from the CPU in a step 53 in response to an instruction from the CPU. In a next step 54, the above-mentioned calculation as shown in the Equation (2) is carried out in the CPU of the circuit 32 based on the coefficient $X_1$ or $X_2$ read out in the step 52 or 53. This computed value is used as a signal of N shown in the aforesaid Equation (1) in a step 55. At the same time, the value $N_{NEW}$ computed in the step 54 is stored in the RAM of the circuit 32 as $N_{old}$, which is used for next calculation in the step 54 as the then signal of $N_{old}$.

Based on both signals $Q_{aNEW}$ and $N_{NEW}$ which are obtained in the steps 47 and 55, respectively, the calculation as shown in the Equation (1) is carried out in the CPU of the circuit 32, and thus computed value is output to the injectors 35 to 38 through the I/O circuit 31 and the injection drive circuit 33.

In the above description, there has been explained one preferred embodiment wherein both air flow signal and revolution signal are fed to the digital filter which has a coefficient variable corresponding to the drive conditions of the internal combustion engine. However, this invention may be modified into another embodiment such that only the air flow signal is fed to the digital filter which has a coefficient variable corresponding to the drive conditions of the internal combustion engine, whereas the revolution signal is fed to the digital filter which has a constant coefficient. In this case, a revolution fluctuation range of the internal combustion engine can be held as low as 60 rpm.

In this connection, a revolution fluctuation range of the internal combustion engine can be reduced down to 40 to 10 rpm also when applying only the revolution signal N to the digital filter which has a constant coefficient. But in this case, a rising characteristic of revolution count is impaired. As an alternative, in case that only the revolution signal N is applied to the digital filter which has a coefficient variable corresponding to the drive conditions of the internal combustion engine, a revolution fluctuation range can be held within 40 to 10 rpm without imparing a rising characteristic of revolution count.

What we claim:

1. In an electrical fuel injector comprising:

an injection valve for injecting fuel into an internal combustion engine; an air flow meter for detecting an amount of intake air fed to said internal combustion engine through a throttle valve; a revolution counter for measuring the rate of rotations of said internal combustion engine; and an electronic circuit for determining an opening and closing time of said injection valve based on output signals from both said air flow meter and said revolution counter, the improvement in that there is provided a first digital filter which filters an input signal with a first coefficient when an opening degree of said throttle valve is smaller than a predetermined value and filters the input signal with a second coefficient larger than said first coefficient when the opening degree of said throttle valve is larger than the predetermined value, and the output signal from said air flow meter is applied to said electronic circuit as the input signal through said first digital filter, whereby said digital filter has a larger effect with said first coefficient than with said second coefficient.

2. An electrical fuel injector according to claim 1, further including a second digital filter having a constant coefficient so as to change the output signal from said revolution counter and then apply the changed output signal to said electronic circuit.

3. An electrical fuel injector according to claim 1, further including a second digital filter which filters another input signal with a first coefficient when the opening degree of said throttle valve is smaller than the predetermined value and filters the another input signal with a second coefficient larger than said first coefficient when the opening degree of said throttle valve is larger than the predetermined value, and the output signal from said revolution counter is applied to said electronic circuit as the another input signal through said second digital filter, whereby said second digital filter has a larger effect than said first coefficient than with said second coefficient.

4. An electrical fuel injector according to claim 3, wherein said second digital filter is so constituted that its coefficient is set to said first or second coefficient upon whether at least one signal among an ON or OFF signal from an idle switch for detecting the opening degree of said throttle valve, the output signal from said revolution counter, the output signal from said air flow meter, and a fuel injection pulse in proportion to a value obtained by dividing the output signal from said air flow meter by the output signal from said revolution counter reaches a predetermined value or not.

5. An electrical fuel injector according to claim 1, wherein said first digital filer is so constituted that its coefficient is set to said first or second coefficient upon whether at least one signal among an ON or OFF signal from an idle switch for detecting the opening degree of said throttle valve, the output signal from said revolution counter, the output signal from said air flow meter, and a fuel injection pulse in proportion to a value obtained by dividing the output signal from said air flow meter by the output signal from said revolution counter reaches a predetermined value or not.

6. In an electric fuel injector comprising: an injection valve for injecting fuel into an itnernal combustion engine; an air flow meter for detecting an amount of intake air fed to said internal combustion engine through a throttle valve; a revolution counter for measuring the rate of rotations of said internal combustion engine; and an electronic circuit for determining an opening and closing time of said injection valve based on output signals from both said air flow meter and said revolution counter, the improvement in that there is provided a first digital filter which filters an input signal with a first coefficient when an opening degree of said throttle value is smaller than a predetermined value and filters the input signal with a second coefficient larger than said first coefficient when an opening degree of said throttle value is larger than the predetermined value, and the output signal from said revolution counter is applied to said electronic circuit as the input signal through said first digital filter, whereby said first digital filter has a larger effect with said coefficient than with said second coefficient.

7. An electrical fuel injector according to claim 6, wherein said first digital filter is so constituted that its coefficient is set to said first or second coefficient upon whether at least one signal among an ON or OFF signal from an idle switch for detecting the opening degree of said throttle valve, the output signal from said revolution counter, the output signal from said air flow meter, and a fuel injection pulse in proportion to a value obtained by dividing the output signal from said air flow meter by the output signal from said revolution counter reaches a predetermined value or not.

* * * * *